United States Patent [19]

Ball

[11] 4,190,395

[45] Feb. 26, 1980

[54] MULTIPLE STAGE PUMP

[75] Inventor: Rowland E. Ball, Long Beach, Calif.

[73] Assignee: Borg-Warner Corporation, Chicago, Ill.

[21] Appl. No.: 901,154

[22] Filed: Apr. 28, 1978

[51] Int. Cl.[2] ..... F01D 13/00; F01D 25/24

[52] U.S. Cl. ..... 415/61; 415/69; 415/189; 415/199.2

[58] Field of Search ..... 415/60, 61, 62, 66, 415/68, 69, 189, 196, 199.1, 199.2

[56] References Cited

U.S. PATENT DOCUMENTS

| | | | |
|---|---|---|---|
| 1,017,001 | 2/1912 | Kane | 415/68 |
| 2,228,425 | 1/1941 | Venderbush | 415/60 |
| 3,801,217 | 4/1974 | Ryall et al. | 415/199.2 |
| 3,927,763 | 12/1975 | Strub et al. | 415/199.2 |
| 4,105,372 | 8/1978 | Mishina et al. | 415/66 |

FOREIGN PATENT DOCUMENTS

| | | | |
|---|---|---|---|
| 1403282 | 5/1969 | Fed. Rep. of Germany | 415/199.1 |

*Primary Examiner*—Louis J. Casaregola
*Attorney, Agent, or Firm*—Aubrey L. Burgess

[57] ABSTRACT

A multiple stage pump having pumping means in an inner case which is removable from the outer case to which supply and discharge conduits are respectively connected to an inlet port and an outlet port without disturbing the conduit connections. The pump stages comprise a first or booster stage having multiple impellers and a second stage of a single impeller, the impellers of the first and second stages being connected to and driven by different shafts, the speeds of which can be independent of one another.

5 Claims, 3 Drawing Figures

MULTIPLE STAGE PUMP

BACKGROUND OF THE INVENTION

Multiple stage centrifugal pumps are well known in the art. Generally, such pumps comprise a plurality of impellers mounted on a common shaft for pumping fluid from an inlet to an outlet. In the usual multiple stage pumps, there are provided interstage volute members for directing the flow of fluid from the discharge of one impeller to the intake of the next succeeding impeller. Some of these pumps are quite big and the housing or case must be removed from its connection with the suction and discharge nozzles for repair of its parts.

THE INVENTION

According to this invention, there is provided an improved multi-stage pump which comprises at least two stages in series, the first stage having multiple impellers capable of operating at low suction pressure and the second having a single impeller capable of operating at higher suction pressure. The first stage impeller thus is capable of operating as a suction pressure booster; the stages are capable of being operated at different speeds. Generally, under the described conditions, the second stage is operated at a higher speed. By so constructing and operating the pump, the diameter of the unit can be reduced when compared to a single stage pump which operates at low suction pressures.

In addition to the structure above described and the operating capabilities of such structure, the multiple stage pump of this invention is fitted into a case with a single suction connection and a single discharge connection such that the impellers and other supporting structure can be removed from the case for inspection, repairs or replacement without disconnecting the external suction and discharge connections. This is accomplished by constructing the case with an inner, conical wall and providing an inner housing associated with the impellers with a complementary shaped conical exterior wall which registers with the case wall upon assembly of the unit.

In order to provide different driving speeds for the impellers of the first and second stages, the drive shafts are preferably concentric; one prime mover can be used; the gear ratio being different for the different shafts.

THE DRAWINGS

DETAILED DESCRIPTION

Figure 1:
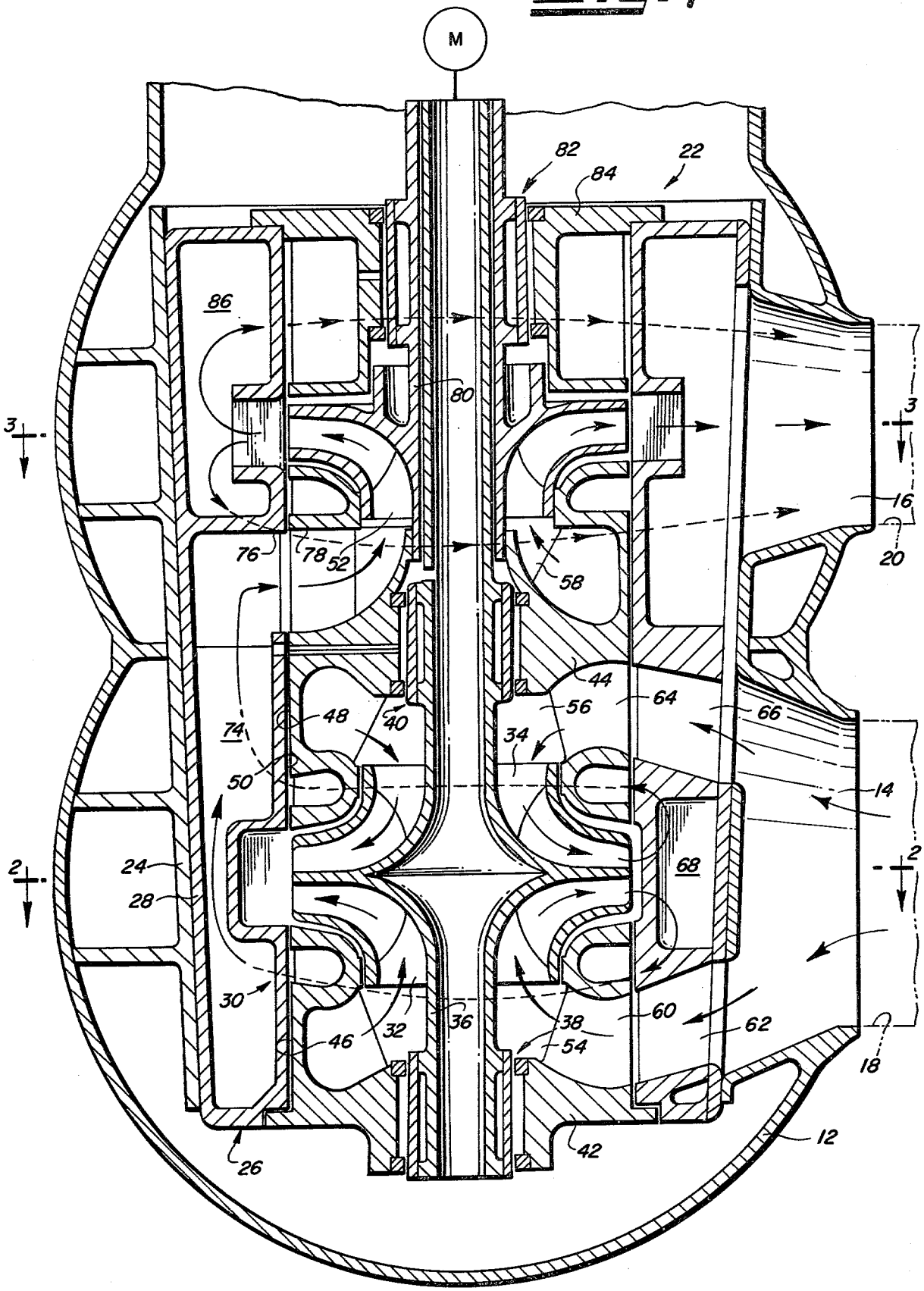
FIG. 1 is a longitudinal sectional view of the pump of this invention taken on line 1—1 of FIG. 2.

With reference to the drawings, the multiple stage pump of this invention comprises an outer case 12 having a suction opening 14 and a discharge opening 16, each connected to a fluid conduit 18 and 20, respectively. As stated, the internal pump structure, generally identified as 22 can be removed without disrupting the connections of 18 and 20 and the case 12. The outer case 12 is constructed with an inner, conical wall 24 and the structure which has been generally indicated as 22 comprises an inner housing 26 having an outer conical wall 28 complementary to the wall 24, so as to be received therein.

Within the inner housing 26 and comprising the first stage 30 of the pump is a pair of impellers 32,34 in series connected with a hollow shaft 36. The impellers 32,34 can be formed integrally with the shaft 36 or separate and connected thereto. The shaft 36 is supported by spaced bearings 38,40 which, in turn, are supported by castings 42,44. The castings 42,44 are constructed with outer cylindrical walls 46,48 received within the inner housing 26. The walls 46,48 contact the inner surface of a wall 50 of the inner housing 26. The casting 42 is an intake casting for the impeller 32. The casting 44 is an intake casting for the impeller 34 and also an intake casting for the second stage impeller 52. Guide vanes 54, 56 and 58 are integral parts of the castings 42 and 44 respectively.

Figure 2:
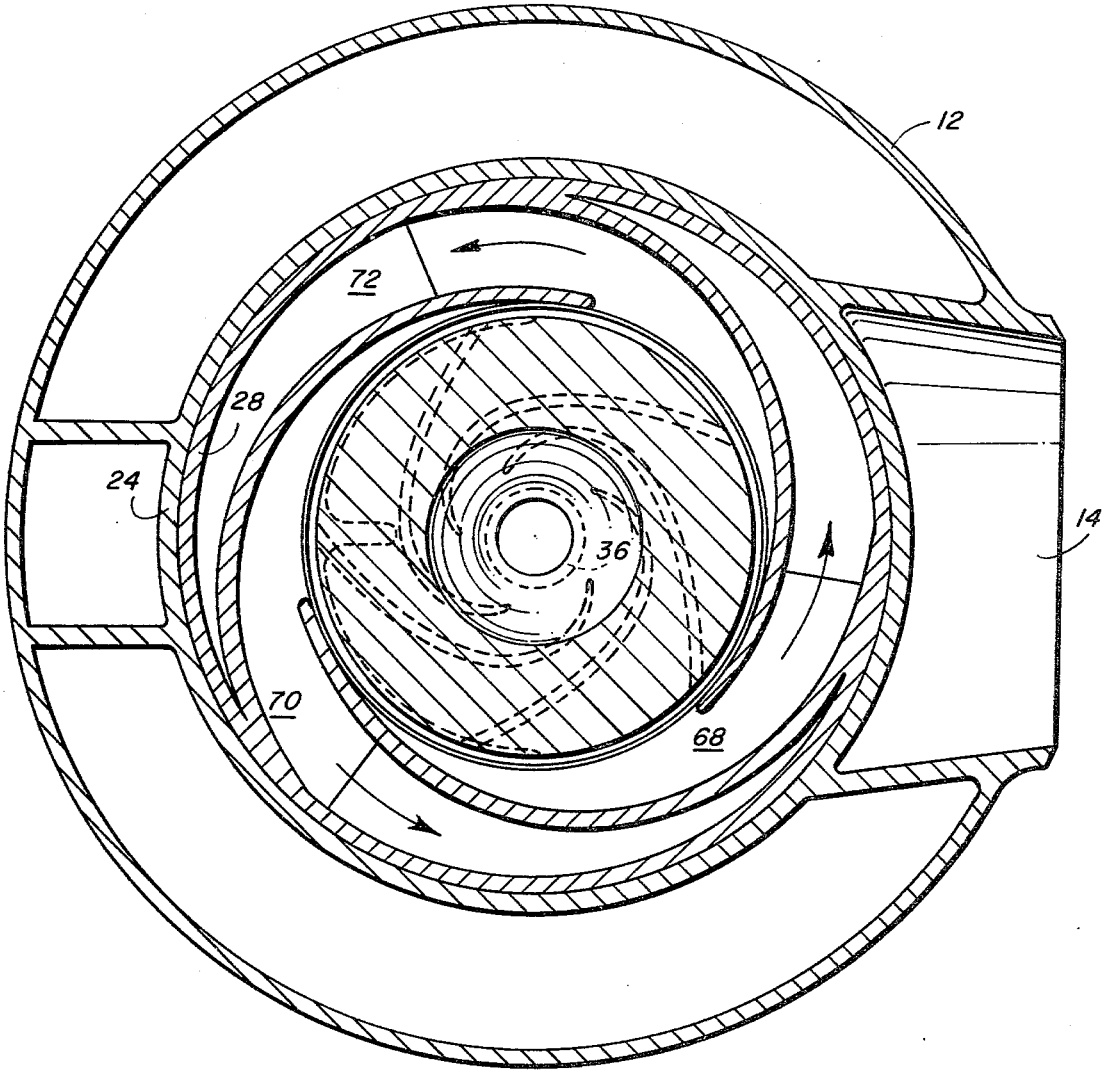
FIG. 2 is a sectional view taken on line 2—2 of FIG. 1.

An intake port 60 of the casting 42 registers with an intake port 62 of the inner housing 26 which in turn communicates with the suction opening 14. An intake port 64 of the casting 44 registers with a second intake port 66 of the inner housing 26 which also communicates with the suction opening 14. The impellers 32,34 discharge into volute discharge passages 68,70,72 (see FIG. 2) in the inner housing between the walls 26 and 50, through the cavity 74 defined by the walls of the inner housing and to a discharge opening 76. The discharge opening 76 communicates with an inlet port 78 in the casting 44 for the second stage impeller 52.

Figure 3:
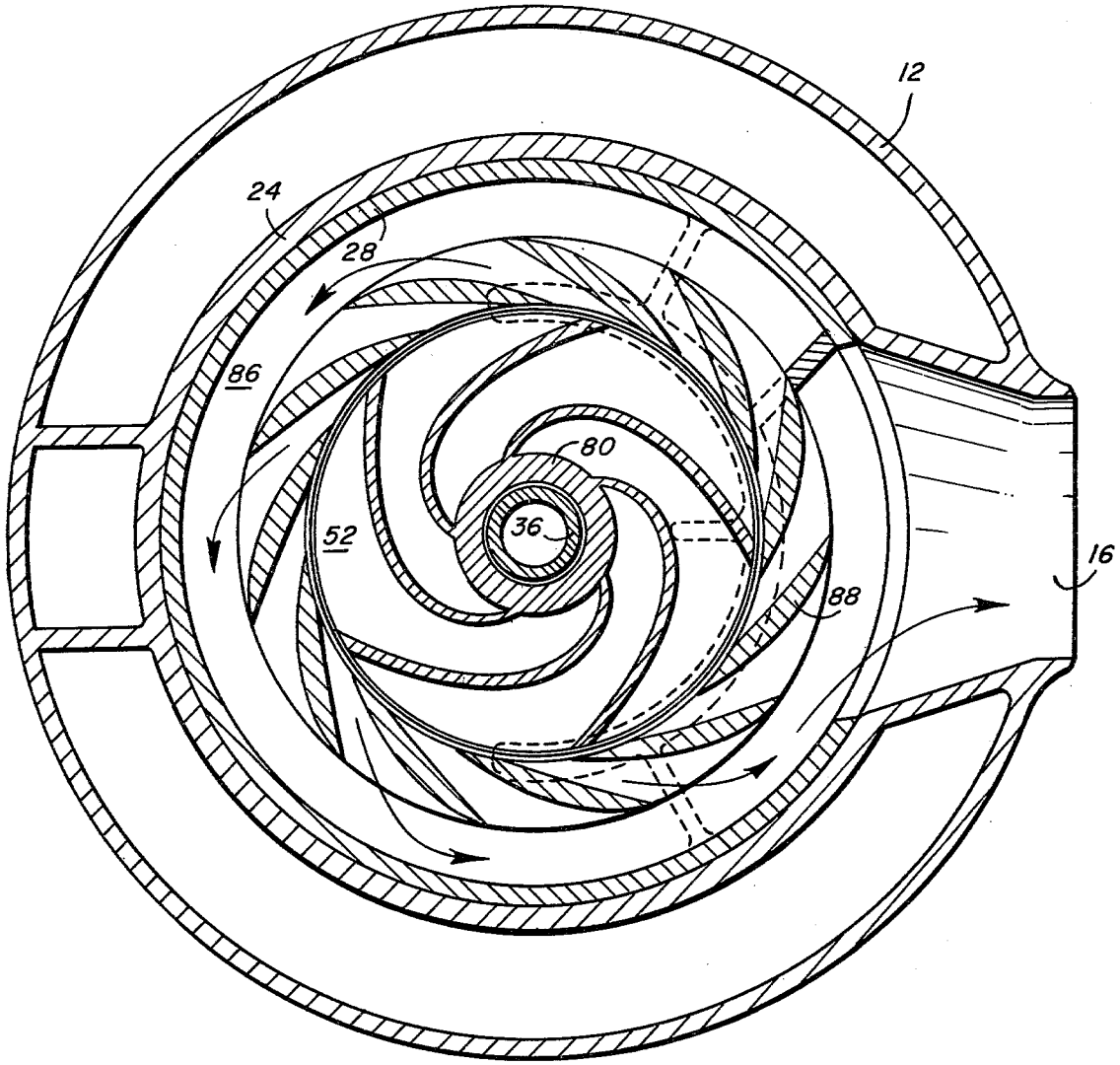
FIG. 3 is a sectional view taken on line 3—3 of FIG. 2.

The second stage impeller 52 is connected to or integrally formed with a hollow shaft 80 wich surrounds and is concentric with the shaft 36 of the first stage. The shaft 80 is supported by bearings, one of which is shown and identified as 82. The bearing 82 is supported by an inner housing closure member 84 which cooperates with the inner housing 26 to position the various parts for operation but which may be easily removed for cleaning and/or repairing the structure. The impeller 52 of the second stage discharges into an annular discharge chamber 86 in the inner housing 26 in which are located a plurality of guide vanes 88 (See FIG. 3) and then to the discharge 16.

As will be noted on the drawings, the path of fluid flow is indicated by the arrows. The first stage of the pump acts as a booster for the second stage. While the pump of this invention has been described as having a first stage of multiple impellers and the second stage as having a single impeller, the stages could each have one impeller or the number of impellers can be reversed.

Any suitable driving means shown schematically as M in FIG. 1 is provided for driving the shafts 36 and 80. Only a single prime mover is required for driving the shafts which may be driven at the same or different speeds, the latter requiring speed control means which are well known in the art and will not be herein described.

I claim:

1. A multi-stage pump comprising:

a case having a suction inlet and a discharge outlet;

a first stage comprising multiple impellers on a first shaft;

a second stage comprising at least one impeller mounted on a second shaft;

means to rotate said shafts and the impellers mounted thereon;

said first stage being so constructed and arranged with respect to said case and said second stage to pump from said suction inlet to said second stage impeller;

said second stage being so constructed and arranged to pump from said first stage to said discharge outlet;

inlet and outlet conduit means connected respectively with said suction inlet and discharge outlet;

an inner housing fitting within said case;

said inner housing containing said first and second impeller stages and being removable as a unit from said case without disconnecting said conduit means from said case;

inner tapered walls defining said case; and an inner housing containing said impellers and having outer defining tapered walls complementary to the inner defining walls of said case.

2. A pump as in claim 1, in which said shafts are rotated independently on one another.

3. A pump as in claim 1, in which said shafts are concentric and capable of rotation independently of one another.

4. A pump as in claim 1, in which said stages are arranged in series, the first stage acting as an intake booster for said second stage.

5. A pump as recited in claim 4 further comprising passageway means in said inner housing for discharge from said first stage and intake for said second stage.

* * * * *